US005606862A

United States Patent [19]

Peckjian et al.

[11] Patent Number: 5,606,862

[45] Date of Patent: Mar. 4, 1997

[54] COMBINED REFRIGERANT RECOVERY, EVACUATION AND RECHARGING APPARATUS AND METHOD

[75] Inventors: Bryan M. Peckjian, Huntingdon Valley; Joseph P. Doyle, Malvern; John H. Reilly, Jr., Rosemont, all of Pa.

[73] Assignee: National Refrigeration Products, Bensalem, Pa.

[21] Appl. No.: 588,588

[22] Filed: Jan. 18, 1996

[51] Int. Cl.[6] ..... F25B 45/00

[52] U.S. Cl. ..... 62/77; 62/292; 62/149

[58] Field of Search ..... 62/77, 85, 292, 62/149, 475, DIG. 2

[56] References Cited

U.S. PATENT DOCUMENTS

| | | |
|---|---|---|
| 2,532,452 | 12/1950 | Hoesel . |
| 3,232,070 | 2/1966 | Sparano . |
| 3,425,238 | 2/1969 | Sylvan . |
| 4,170,116 | 10/1979 | Williams . |
| 4,242,878 | 1/1981 | Brinkerhoff . |
| 4,285,206 | 8/1981 | Koser . |
| 4,363,222 | 12/1982 | Cain . |
| 4,412,431 | 11/1983 | Waldrep . |
| 4,458,497 | 7/1984 | Kubik . |
| 4,476,688 | 10/1984 | Goddard . |
| 4,476,693 | 10/1984 | Johnson . |
| 4,480,446 | 11/1984 | Margulefsky et al. . |
| 4,513,578 | 4/1985 | Proctor et al. . |
| 4,550,573 | 11/1985 | Rannenberg . |
| 4,566,291 | 1/1986 | Halavais . |
| 4,584,838 | 4/1986 | AbuJudom, II . |
| 4,688,388 | 8/1987 | Lower et al. . |
| 4,766,733 | 8/1988 | Scuderi . |
| 4,805,416 | 2/1989 | Manz et al. . |
| 4,809,515 | 3/1989 | Houwink . |
| 4,809,520 | 3/1989 | Manz et al. . |
| 4,856,289 | 8/1989 | Lofland . |
| 4,856,290 | 8/1989 | Rodda . |
| 4,934,390 | 6/1990 | Sapp . |
| 4,938,031 | 7/1990 | Manz et al. . |
| 4,942,741 | 7/1990 | Hancock et al. . |
| 4,969,495 | 11/1990 | Grant . |
| 4,996,848 | 3/1991 | Nelson et al. . |
| 4,998,413 | 3/1991 | Sato et al. . |
| 5,020,331 | 6/1991 | Michny . |
| 5,046,320 | 9/1991 | Loose et al. . |
| 5,095,713 | 3/1992 | Laukhuf et al. . |
| 5,127,239 | 7/1992 | Manz et al. . |
| 5,146,761 | 9/1992 | Cavanaugh et al. . |
| 5,170,632 | 12/1992 | Reilly, Jr. et al. . |
| 5,172,562 | 12/1992 | Manz et al. ..... 62/292 |
| 5,230,224 | 7/1993 | Rickets et al. ..... 62/292 |
| 5,247,802 | 9/1993 | Maniez et al. . |
| 5,282,366 | 2/1994 | Reilly, Jr. et al. . |

OTHER PUBLICATIONS

RIGID SystemSafe brochure entitled "RS-200 Refrigerant Recovery Unit" dated 1993.

OZsaver Light Operations Manual entitled "Recovery & Charging Station" Aug. 1988.

SRD 1 Operations Manual entitled "Streamline Recovery Device" May 1992.

National Refrigeration Products catalog dated 1992.

*Primary Examiner*—John M. Sollecito

*Attorney, Agent, or Firm*—Dickstein Shapiro Morin & Oshinsky LLP

[57] ABSTRACT

A combined refrigerant recovery, evacuation and recharging apparatus for transferring refrigerant from a first container to a second container and deeply evacuating the first container. The apparatus includes a compressor having a suction side and a discharge side, a vacuum pump having a suction side and a discharge side, and a motor which is coupled with and drivingly engageable to the compressor and the vacuum pump.

23 Claims, 6 Drawing Sheets

COMBINED REFRIGERANT RECOVERY, EVACUATION AND RECHARGING APPARATUS AND METHOD

FIELD OF THE INVENTION

The present invention relates to an apparatus for recovering refrigerant and, more particularly, to an apparatus for recovering refrigerant from a first container and evacuating the container for service or recharging.

BACKGROUND OF THE INVENTION

Commercial and residential refrigeration units, such as refrigerators, air conditioners, heat pumps and other small air-conditioning and refrigeration units use chlorofluorocarbons (CFC's) as a standard heat-transfer media. For many years, when a refrigeration unit needed servicing, it was common practice in the industry to simply release the refrigerant to the atmosphere. That practice is no longer acceptable, nor is it responsible to abandon CFC-containing equipment because it would eventually leak out. It has become increasingly desirable to service CFC-containing units in a manner which prevents the loss of CFC's to the atmosphere or the environment, and to remove CFC's from non-serviceable units before the refrigerant leaks out.

Generally, when servicing units, it is both cost effective and environmentally responsible to recover refrigerant from the unit prior to servicing. After a unit is opened and serviced, it must then be evacuated of all moisture and/or other contaminants prior to recharging the unit with refrigerant. Failure to properly evacuate a unit prior to recharging can result in damage to the compressor, and/or freezing up of refrigerant lines when in use.

In one known system, a refrigerant recovery apparatus having a compressor, a condenser and a refrigerant storage container is used to recover refrigerant from a unit to be serviced. Due to limitations on the vacuum pressure which can be generated by the recovery compressor, the unit to be serviced cannot be fully evacuated prior to recharging using a recovery unit alone. The recovery apparatus is then generally disconnected from the unit then being serviced, and a vacuum pump is connected to the unit to draw a vacuum on the unit to fully evacuate the system.

One disadvantage of this type of system is the need to use two different pieces of equipment, one for recovering refrigerant from the system and a separate vacuum pump for completely evacuating the system.

Another known system provides a refrigerant recovery, purification and recharging system which includes a compressor driven by a first motor connected by a solenoid valve to the container to be evacuated, and a separate vacuum pump driven by its own motor, also connected by solenoid valves to the unit to be evacuated. The refrigerant is first recovered by setting the solenoid valves such that the compressor draws the refrigerant from the unit, compresses the refrigerant prior to passing the refrigerant through a condenser, and on to the recovery container. After the refrigerant has been recovered to a level acceptable by the EPA, the system is evacuated by a separate evacuation process utilizing the vacuum pump.

One drawback of this system is that both the compressor and the vacuum pump have separate motors, and although there is some convenience in having recovery and evacuation capabilities in a single piece of equipment, the weight and size of the unit are increased by the separate motors.

The present invention is a result of observation of the problems associated with the prior art devices, and efforts to solve them.

SUMMARY OF THE INVENTION

The present invention provides a combined refrigerant recovery, evacuation and recharging apparatus for transferring refrigerant from a first container to a second container and evacuating the first container. The apparatus comprises a compressor having a suction side and a discharge side. The suction side of the compressor is adapted for connection to the first container. A vacuum pump having a suction side and a discharge side is provided. The suction side of the vacuum pump is adapted for connection to the first container. A motor which is drivingly engageable to the compressor and the vacuum pump is also provided.

The present invention also provides a combined refrigerant recovery, evacuation and recharging apparatus for transferring refrigerant from a first container to a second container and evacuating the first container. A compressor having a suction side and a discharge side is provided. The suction side is in fluid communication with the first container and the discharge side is in fluid communication with the second container. A vacuum pump having a suction side and a discharge side is also provided. The suction side of the vacuum pump is in fluid communication with the first container. The apparatus further includes a motor which is drivingly engageable to the compressor and the vacuum pump.

In another aspect, the present invention provides a method for recovering refrigerant from a first container, storing the refrigerant in a second container, and evacuating the first container. The method comprises the steps of:

(a) actuating a motor to drive a compressor;

(b) removing refrigerant from the first container and compressing the refrigerant from the first container with the driven compressor to form a relatively high temperature, high pressure vaporized refrigerant;

(c) condensing the high temperature, high pressure refrigerant from step (b);

(d) passing the condensed refrigerant from step (c) into the second container;

(e) detecting a predetermined vacuum pressure within the first container;

(f) driving a vacuum pump with the motor to evacuate the first container with the vacuum pump upon detecting the predetermined pressure.

The present invention also provides a method of clearing trapped refrigerant from a refrigerant recovery apparatus having a compressor with a suction side adapted for connection to a first container and a discharge side adapted for connection to a second container, with the compressor being driven by a motor. The method comprises the steps of:

(a) providing a vacuum pump having a suction side and a discharge side, the suction side of the vacuum pump being in fluid communication with the suction and discharge sides of the compressor;

(b) operating the vacuum pump with the motor which drives the compressor;

(c) drawing a vacuum with the vacuum pump on the suction and discharge sides of the compressor;

(d) discharging the refrigerant through the discharge side of the vacuum pump to atmosphere.

The present invention further provides a method of operating a refrigerant recovery and evacuation apparatus for recovering refrigerant from a first container and transferring the recovered refrigerant to a second container, and evacuating the first container and the apparatus. The apparatus includes a compressor having a suction side and a discharge side. A first hose coupling fitting is exposed on the apparatus, with the first hose coupling fitting being in fluid communication with the suction side of the compressor. A second hose coupling fitting is exposed on the apparatus, with the second hose coupling fitting being in fluid communication with the discharge side of the compressor. A vacuum pump is provided in fluid communication with the suction and discharge sides of the compressor. A motor is provided which is drivingly engageable to the compressor and the vacuum pump. A first clutch is connected between the motor and the compressor. The first clutch has a first state in which the motor is drivingly engaged with the compressor and a second state in which the motor is disengaged from the compressor. A second clutch is connected between the motor and the vacuum pump. The second clutch has a first state in which the motor is drivingly engaged with the vacuum pump and a second state in which the motor is disengaged from the vacuum pump. A vacuum switch is provided in fluid communication with the first hose coupling fitting to respond to vacuum pressure and coupled with the first and second clutches to reverse the states of the first and second clutches when exposed to a predetermined vacuum pressure. The recovery and evacuation apparatus is operated in first and second modes with automatic switching from the first mode to the second mode. The method comprises:

(a) actuating the first clutch to the first state and the second clutch to the second state to engage the motor to drive the compressor;

(b) removing refrigerant from the first container and compressing the refrigerant from the first container with the driven compressor to form a relatively high temperature, high pressure vaporized refrigerant;

(c) condensing the high temperature, high pressure refrigerant from step (b);

(d) passing the condensed refrigerant from step (c) into the second container;

(e) detecting a predetermined vacuum pressure within the first container;

(f) automatically switching to the second mode of operation by reversing the states of the first and second clutches upon detecting the predetermined vacuum pressure;

(g) driving the vacuum pump with the motor upon detecting the predetermined pressure; and (h) evacuating the first container and the refrigerant recovery apparatus with the vacuum pump.

BRIEF DESCRIPTION OF THE DRAWINGS

The foregoing summary, as well as the following detailed description of the preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION OF PREFERRED EMBODIMENT

Figure 1:
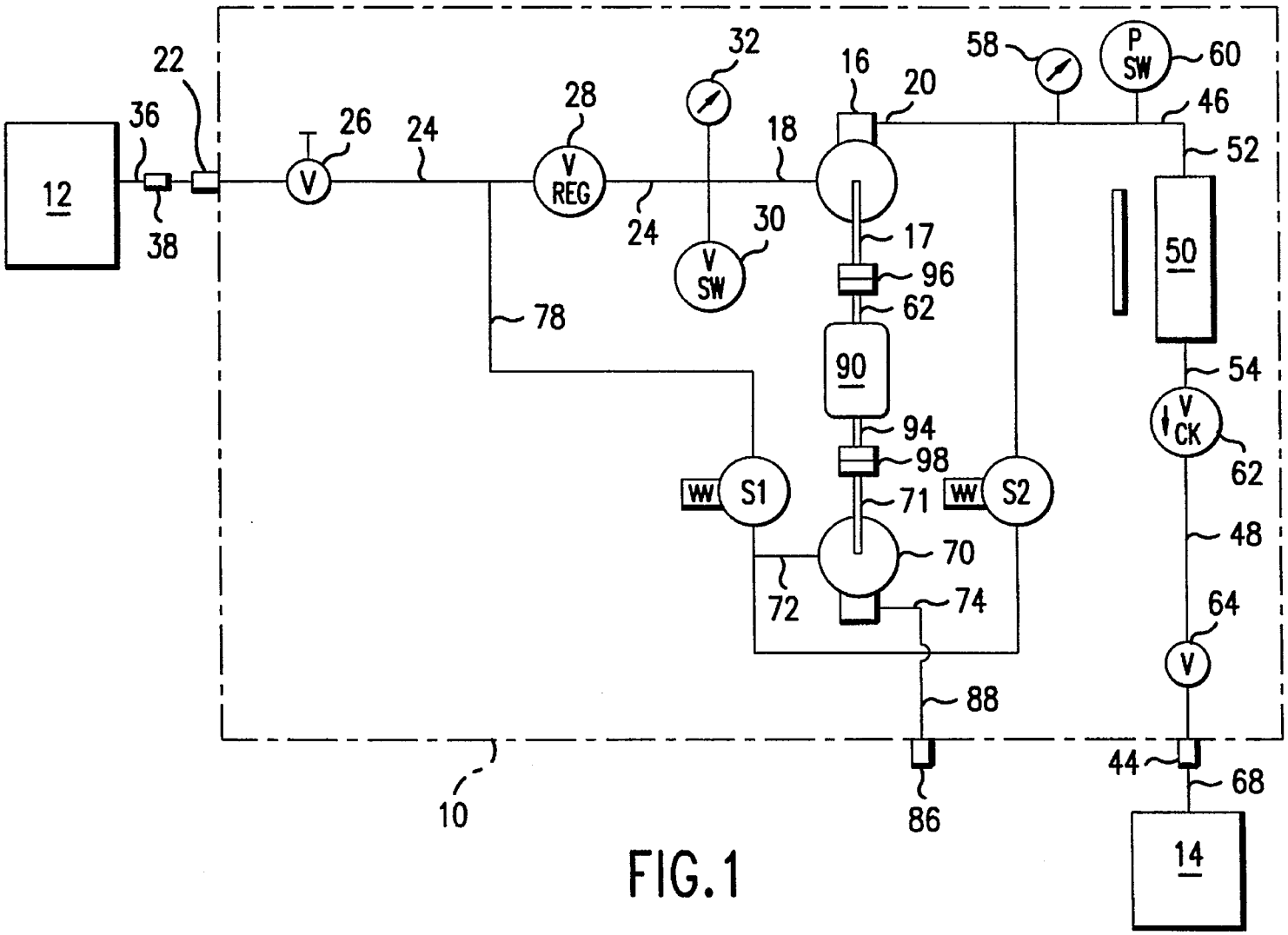
FIG. 1 is a schematic diagram of a first embodiment of a refrigerant recovery, evacuation and recharging apparatus in accordance with the present invention.

Certain terminology is used in the following description for convenience only and is not limiting. The words "right," "left," "lower" and "upper" designate directions in the drawings to which reference is made. The words "inwardly" and "outwardly" refer to directions toward and away from, respectively, the geometric center of the refrigerant recovery, evacuation and recharging apparatus and designated parts thereof. The terminology includes the words above specifically mentioned, derivatives thereof and words of similar import.

Figure 2:
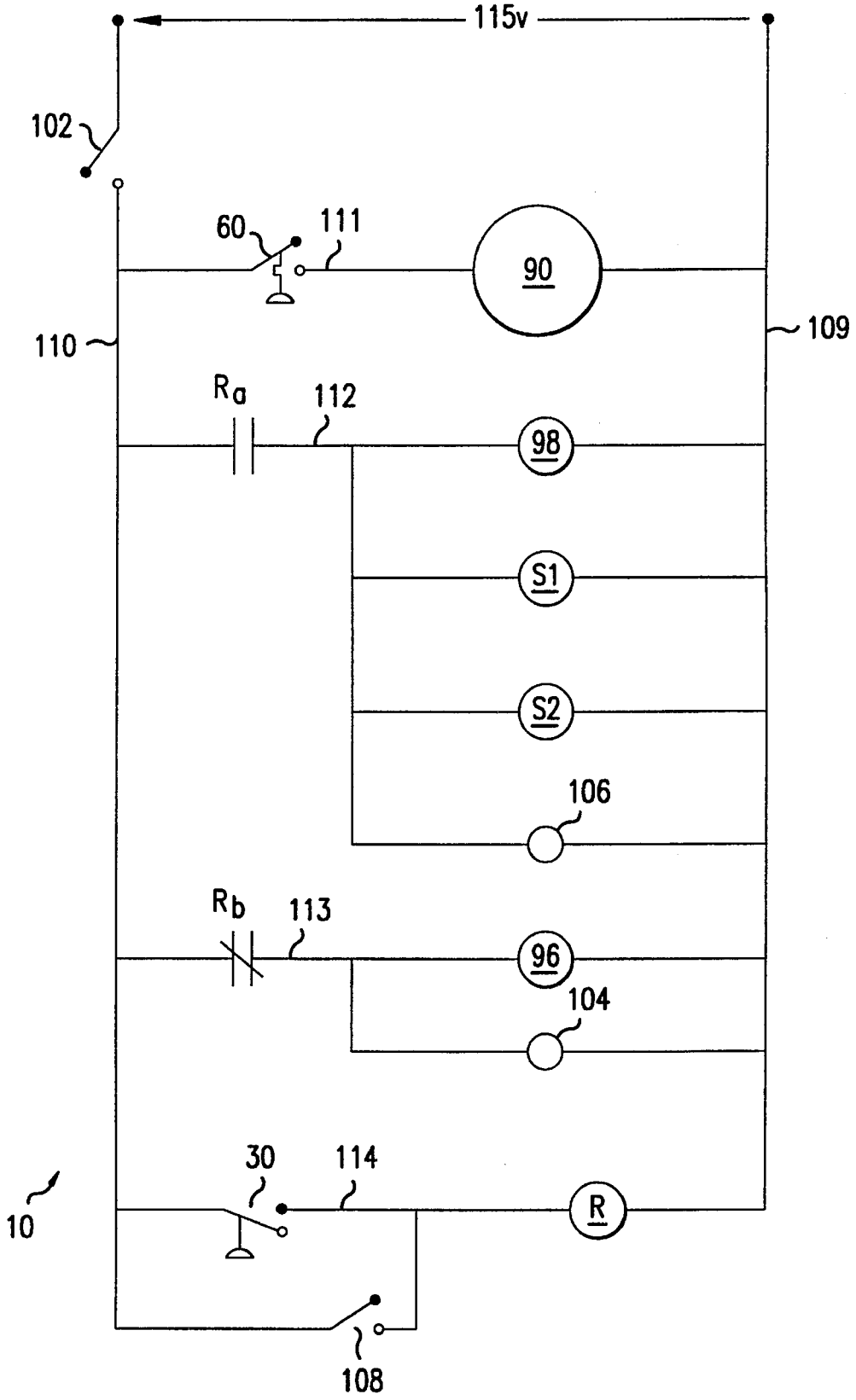
FIG. 2 is a schematic wiring diagram of the first embodiment of the refrigerant recovery and recycling apparatus.

Referring to the drawings, wherein like numerals indicate like elements throughout, there is shown in FIGS. 1 and 2 a first preferred embodiment of a combined refrigerant recovery, evacuation and recharging apparatus, generally designated 10 (hereinafter "the refrigerant recovery apparatus 10"), in accordance with the present invention.

Referring to FIG. 1, the refrigerant recovery apparatus 10 is used for transferring refrigerant from a first container 12 to a second container 14. The first container 12 may be a small appliance, such as a household refrigerator, air-conditioning unit, or heat pump, or any other small air-conditioning and/or refrigeration system well known to those of ordinary skill in the art. The present invention is also not limited to use with the specific types of refrigerant containers discussed above, and may also be used to recover refrigerant from automotive air conditioners, for example, as is understood by the ordinarily skilled artisan. The second container 14 is typically a transportable recovery tank in which the recovered refrigerant can be temporarily stored prior to recharging, or stored and removed.

The refrigerant to be transferred is preferably of the high-pressure type, which exists as both a liquid and a gas at room temperature within the pressurized first container 12. Preferably, a refrigerant such as R-12, R-22, R-500, R-502 and R-134A may be recovered by use of the present invention. Those of ordinary skill in the art will understand from the present disclosure that a wide variety of refrigerants, too numerous to mention, may also be transferred and recycled with the present invention.

Still with reference to FIG. 1, the refrigerant recovery apparatus 10 (encompassed in phantom lines) includes a compressor 16 having a suction side 18 and a discharge side 20, with the suction side 18 of the compressor 16 being adapted for connection to the first container 12. The compressor 16 is configured to produce a first relatively lower pressure or partial vacuum at the suction side 18 for drawing refrigerant into the compressor 16. The compressor 16 transfers the refrigerant through the remainder of the refrigerant recovery apparatus 10 by expelling refrigerant from the discharge side 20 at a second pressure, above the atmospheric pressure, and above the pressure of the suction side 18 of the compressor 16. The compressor may be an oiless compressor, or may have an oil port (not shown) and an oil separator (not shown) located on the discharge side 20 of the compressor 16. These types of compressors are known to those of ordinary skill in the art, and accordingly further description is not believed necessary or limiting.

The suction side 18 of the compressor 16 is in fluid communication with the first container 12. More particularly, a first hose coupling fitting 22 is provided exposed on the apparatus 10. The first hose coupling fitting 22 is in fluid communication with the suction side of the compressor 16 through a first conduit 24. Preferably, the first conduit 24 includes a manual shutoff valve 26 and a pressure regulator 28 located in series along the first conduit 24. A vacuum switch 30 and a pressure gauge 32 are also fluidly connected to the first conduit 24. The first conduit 24, and the other conduits of the apparatus 10 described hereinafter, are formed from copper tubing, unless otherwise indicated. However, it is understood by those of ordinary skill in the art from the present disclosure that the first conduit 24 and the other conduits described below may be made from any other suitable material which is impervious to the refrigerant to be transferred, such as suitable polymeric or metallic materials.

Preferably, the valve 26 is a hand-operated ball valve. However, it is understood by those of ordinary skill in the art from the present disclosure that other types of valves may be used, such as automatically controlled solenoid valves or gate valves. The pressure regulator 28, vacuum switch 30 and pressure gauge 32 are of the type generally known to those of ordinary skill in the art, and accordingly further description is not believed to be necessary or limiting.

Preferably, the first hose coupling fitting 22 is connected to the first container 12 through an inlet hose 36. Preferably, the inlet hose 36 is a flexible refrigerant hose, of the type generally known to those of ordinary skill in the art. A pre-filter 38 is preferably fluidly connected with the inlet hose 36. The pre-filter 38 is a particle filter which traps particulate matter in the refrigerant being drawn from the first container 12 to prevent malfunctioning of the components of the refrigerant recovery apparatus 10. Pre-filter cartridges such as ALCO No. ALF-032, Parker No. PF052-MF, or Sporlan No. C-052 may be used in conjunction with the preferred embodiment. However, it is understood by those of ordinary skill in the art from the present disclosure that other suitable pre-filters can be used, if desired.

It will be recognised by those skilled in the art from the present disclosure that an additional filter can be provided in series along the first conduit 24, if desired, to filter out acids and moisture.

The discharge side 20 of the compressor 16 is in fluid communication with the second container 14. More particularly, a second hose coupling fitting 44 is exposed on the apparatus 10. The second hose coupling fitting 44 is in fluid communication with the discharge side 20 of the compressor 16. A condenser 50, having a condenser inlet 52 and a condenser outlet 54, is in fluid communication between the discharge side 20 of the compressor 16 and the second hose coupling fitting 44. More particularly, a second conduit 46 is provided in fluid communication between the discharge side 20 of the compressor 16 and the inlet 52 of the condenser 50. A third conduit 48 is provided in fluid communication between the outlet side 54 of the condenser 50 and the second hose coupling fitting 44. Preferably, a fan 56 is located adjacent to the condenser 50 to generate an airflow over the condenser 50. The condenser 50 is of the type generally known to those of ordinary skill in the art, and accordingly further description is not believed necessary or limiting.

A pressure gauge 58 and a high-pressure cut-off switch 60 are provided in fluid communication with the discharge side 20 of the compressor 16 through the second conduit 46. The pressure gauge 58 is preferably exposed on the apparatus and displays the pressure on the high pressure side of the compressor 16. The high-pressure cut-off switch 60 turns off the refrigerant recovery apparatus 10 if the pressure in the apparatus exceeds a predetermined limit. In the presently preferred embodiment, the high-pressure cutoff switch is set at approximately 425 PSI. A check valve 62 is provided in the third conduit 48 between the outlet 54 of the condenser 50 and the second hose coupling fitting 44. The check valve 62 prevents back flow of refrigerant from the second container 14 toward the condenser outlet 54, and is of the type generally known to those of ordinary skill in the art. A second manual shut-off valve 64 is located along the third conduit 48 adjacent to the second hose coupling fitting 44. The second manual shut-off valve 64 is similar to the first manual shut-off valve 26. Preferably, a second flexible refrigerant hose 68 is provided between the second hose coupling fitting 44 and the second container 14.

The refrigerant recovery apparatus 10 further includes a vacuum pump 70 having a suction side 72 and a discharge side 74, with the suction side 72 of the vacuum pump 70 being adapted for connection to the first container 12. Preferably, the suction side 72 of the vacuum pump 70 is in fluid communication with the first hose coupling fitting 22 and with the suction side 18 of the compressor 16. More particularly, a fourth conduit 78 is provided in fluid communication between the suction side 72 of the vacuum pump 70 and the first conduit 24. Preferably, a first valve S1, actuatable between an open state and a closed state, is in fluid communication between the first hose coupling fitting 22 and the suction side 72 of the vacuum pump 70. Preferably, the first valve S1 is a solenoid valve and is located in the fourth conduit 78.

The suction side 72 of the vacuum pump 70 is also in fluid communication with the discharge side 20 of the compressor 16 and with the second hose coupling 44. More particularly, the suction side 72 of the vacuum pump 70 is in fluid communication with the second conduit 46 via a fifth conduit 82. A second valve $2, actuatable between an open state and a closed state is in fluid communication between the second hose coupling fitting 44 and the vacuum pump 70. Preferably, the second valve S2 is a solenoid valve, similar to the first solenoid valve S1, and is located in the fifth conduit 82. The discharge side 74 of the vacuum pump 70 is in fluid communication with a refrigerant outlet exposed at least to atmosphere on the refrigerant recovery apparatus 10 via a sixth conduit 88. The refrigerant outlet is preferably provided by a third refrigerant hose coupling fitting 86 exposed on the apparatus 10.

Still with reference to FIG. 1, the refrigerant recovery apparatus 10 further comprises a motor 90 coupled with and drivingly engageable to the compressor 16 and the vacuum pump 70. Preferably, the motor 90 is an electric motor having two output shafts 92 and 94. A first clutch 96 is connected between the motor 90 and the compressor 16. The first clutch 96 has a first state in which the motor 90 is drivingly engaged with the compressor 16 and a second state in which the motor 90 is disengaged from the compressor 16. During refrigerant recovery, the first clutch 96 is in the first state. Preferably, the first clutch 96 is an electric clutch which can be activated between the first state and the second state by providing an electric current to the clutch, and is of the type generally known to those of ordinary skill in the art. One side of the first clutch 96 is preferably attached to the first output shaft 92 of the motor 90 and the other side of the first clutch 96 is preferably attached to the drive shaft 17 for the compressor 16.

A second clutch 98 is connected between the motor 90 and the vacuum pump 70. The second clutch 98 has a first state in which the motor 90 is drivingly engaged with the vacuum pump 70 and a second state in which the motor 90 is disengaged from the vacuum pump 70. During refrigerant recovery, the second clutch 98 is in the second state. Preferably, one side of the second clutch 98 is attached to the second output shaft 94 of the motor 90 and the other side of the second clutch 98 is attached to the drive shaft 71 for the vacuum pump 70. Preferably, the second clutch 98 is an electric clutch similar to the first clutch 96.

The vacuum switch 30 is preferably in fluid 10 communication with the first hose coupling fitting 22 via first conduit 24 as previously discussed. The vacuum switch 30 responds to vacuum pressure and is coupled with the first and second clutches 96 and 98 to reverse the states of the first and second clutches 96 and 98 when exposed to a predetermined vacuum pressure, switching the apparatus 10 from the recovery mode to the evacuation mode. In the evacuation mode, the first clutch 96 is in the second state and the second clutch 98 is in the first state, such that the motor 90 is drivingly engaged to only the vacuum pump 70.

Referring now to FIG. 2, a schematic wiring diagram for the refrigerant recovery apparatus 10 is shown. An ON/OFF switch 102 is connected across a power source, which is preferably a 115 volt AC source, to control power to the refrigerant recovery apparatus 10. When the switch 102 is in the on position, power is provided by conductors 109 and 110 to the circuit as described in detail below.

A first circuit element 111, which is electrically connected in parallel between conductors 109 and 110, provides power to the motor 90 which is electrically connected in series with the high-pressure cut-off switch 60. The high-pressure cut-off switch 60 interrupts power to the motor 90 when the pressure in the apparatus 10 exceeds the predetermined limit. A second circuit element 112 is electrically connected between the conductors 109 and 110. The second circuit element 112 is comprised of a first relay switch Ra of a relay R. The first relay switch Ra is in an open state, and closes when power is provided to the relay R, as explained in more detail below. The second clutch 98, the first and second solenoid valves S1 and S2, and an evacuation indicator light 106 are electrically connected in parallel between the first relay switch and the conductor 109.

A third circuit element 113 is electrically connected between the conductors 109 and 110. The third circuit element 113 comprises a second relay switch Rb of the relay R, which is normally closed and opens when power is provided to the relay R. The first clutch 96 and a recovery indicator light 104 are electrically connected in parallel between the second relay switch Rb and the conductor 109.

A fourth circuit element 114 is provided between the conductors 109 and 110. The fourth circuit element 114 comprises the vacuum switch 30 which is wired in series with the relay R. When a predetermined vacuum pressure is achieved by the compressor, the vacuum switch 30 closes providing power to the relay R. This causes the first relay switch Ra to close and the second relay switch Rb to open. When the first relay switch Ra closes, power is provided to the second clutch 98 so that the motor 90 is drivingly engaged with the vacuum pump 70. Power is also provided to the first and second solenoid valves S1 and S2, which causes the first and second solenoid valves to open. When the second relay switch Rb opens, the first clutch 96 disengages the motor 90 from the compressor 16.

A separate evacuation by-pass switch 108 is wired in parallel with the vacuum switch 30 to allow the vacuum pump 70 to be operated at any desired time by the user.

It is understood by those of ordinary skill in the art that various components, such as the valves, pressure gauges, filters, relays and the like are standard items which are readily available, and are interconnected in a manner which is understood by those of ordinary skill in the art. Accordingly, further description is not believed to be necessary and, therefore, is not provided for convenience only and is not considered to be limiting.

Figure 3:
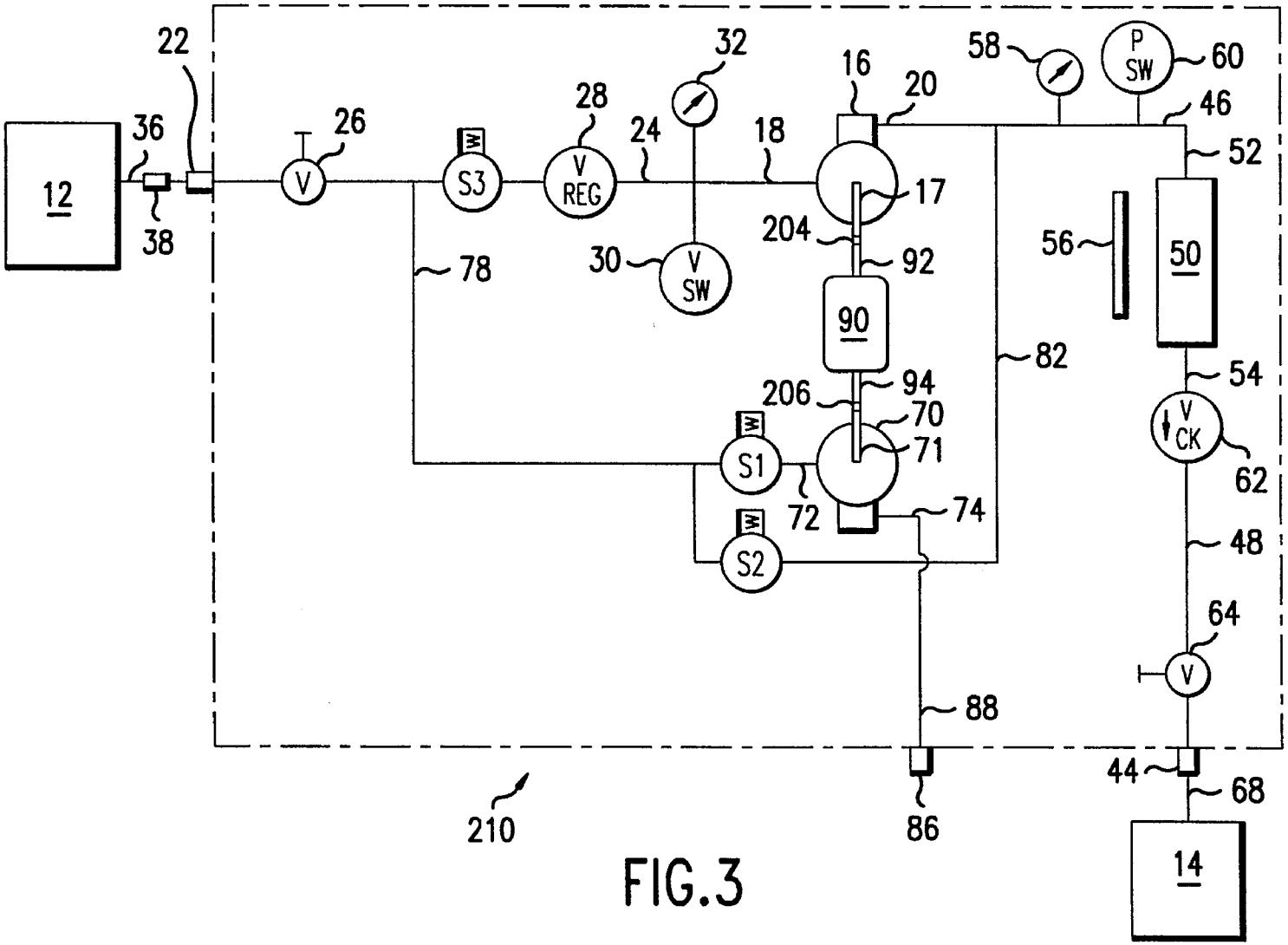
FIG. 3 is a schematic diagram of a second embodiment of a refrigerant recovery, evacuation and recharging apparatus.
Figure 4:
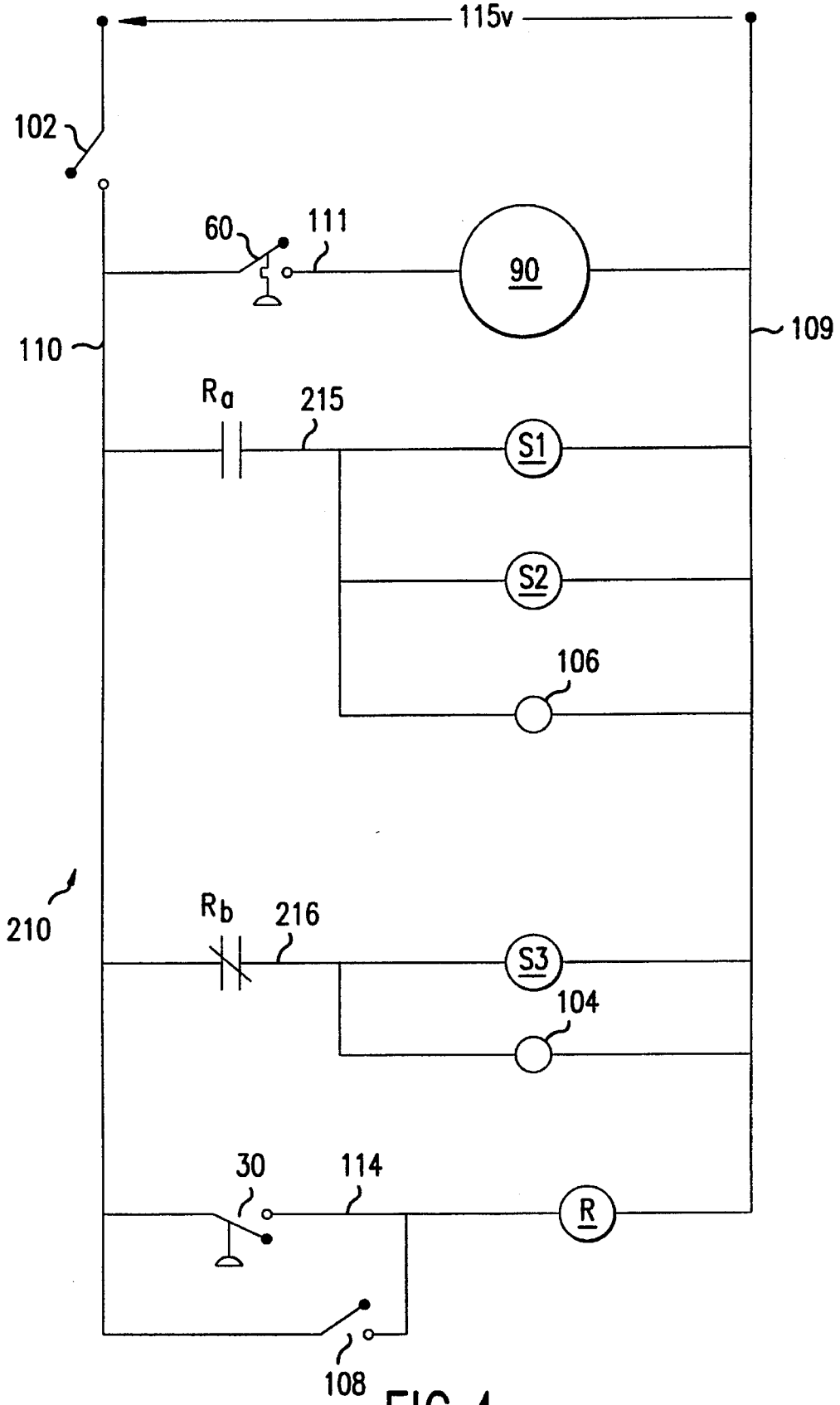
FIG. 4 is a schematic wiring diagram of the second embodiment of the refrigerant recovery and recycling apparatus.

Referring now to FIGS. 3 and 4 a second preferred embodiment of a combined refrigerant recovery, evacuation and recharging apparatus, generally designated 210 (hereinafter "the refrigerant recovery apparatus 210") is shown. The second preferred embodiment is very similar to the first embodiment 10 except for the following differences.

Referring to FIG. 3, a third valve S3, actuatable between an open state and a closed state, is provided in fluid communication between the suction side 18 of the compressor 16 and the first container 12. More particularly, the third valve S3 is located between the compressor and the first hose coupling fitting 22, and is preferably adjacent to the pressure regulator 28. The first valve S1 is also preferably located adjacent to the inlet on the suction side 72 of the vacuum pump 70. The third valve S3 is preferably a solenoid actuated valve, similar to the first and second valves S1, S2, as described above.

It will be recognized by those of ordinary skill in the art from the present disclosure that the third solenoid valve S3 could be omitted, with a resulting loss in efficiency to the apparatus 210.

Still with reference to FIG. 3, the motor 90 is coupled with and continuously drivingly engaged to both the compressor 16 and the vacuum pump 70. Preferably, the output shafts 92, 94 of the motor 90 are attached with couplings 204 and 206 to the drive shafts 17 and 71 of the compressor 16 and vacuum pump 70, respectively. It will be recognized by those of ordinary skill in the art from the present disclosure that the drive shafts 17 and 71 for the compressor 16 and the vacuum pump 70 can be driven from a single output shaft from the motor 90 through a system of belts and pulleys, gears, chains and sprockets or the like. Depending on the motor speed and the desired RPM's for the compressor 16 and vacuum pump 70, speed ratio reductions can be made through the use of different sized pulleys or gears in a manner known to the ordinarily skilled artisan.

Referring to FIG. 4, a new second circuit element 215 has replaced the second circuit element 112 of the first embodiment 10. The second circuit element 215 is electrically connected between the conductors 109 and 110. The second circuit element 215 is comprised of the first relay switch Ra of the relay R. The first relay switch Ra is in an open state, and closes when power is provided to the relay R. The first and second solenoid valves S1 and S2, and the evacuation indicator light 106 are electrically connected in parallel between the first relay switch Ra and the conductor 109.

Still with reference to FIG. 4, a new third circuit element 216 has replaced the third circuit element 113 of the first embodiment 10. The third circuit element 216 is electrically connected in parallel with the other circuit elements between the conductors 109 and 110. The third circuit element 216 comprises the second relay switch Rb of the relay R, which is normally closed and opens when power is provided to the relay R. The third valve S3 and the recovery indicator light 104 are electrically connected in parallel between the second relay switch Rb and the conductor 109.

When the power switch 102 is turned on, the motor 90 continuously drives both the compressor 16 and the vacuum pump 70. The first and second solenoid valves S1 and S2 are in a closed state, isolating the vacuum pump 70 from the rest of the system. The third solenoid valve S3 is in an open state, such that the compressor 16 is in fluid communication with the first container 12. When a predetermined vacuum pressure is achieved by the compressor 16, the vacuum switch 30 closes providing power to the relay R. This causes the first relay switch Ra to close and the second relay switch Rb to open. When the first relay switch Ra closes, power is provided to the first and second solenoid valves S1 and S2, which causes the first and second solenoid valves to open. When the second relay switch Rb opens, power to the third solenoid valve S3 is interrupted causing the third solenoid valve S3 to close.

Figure 5:
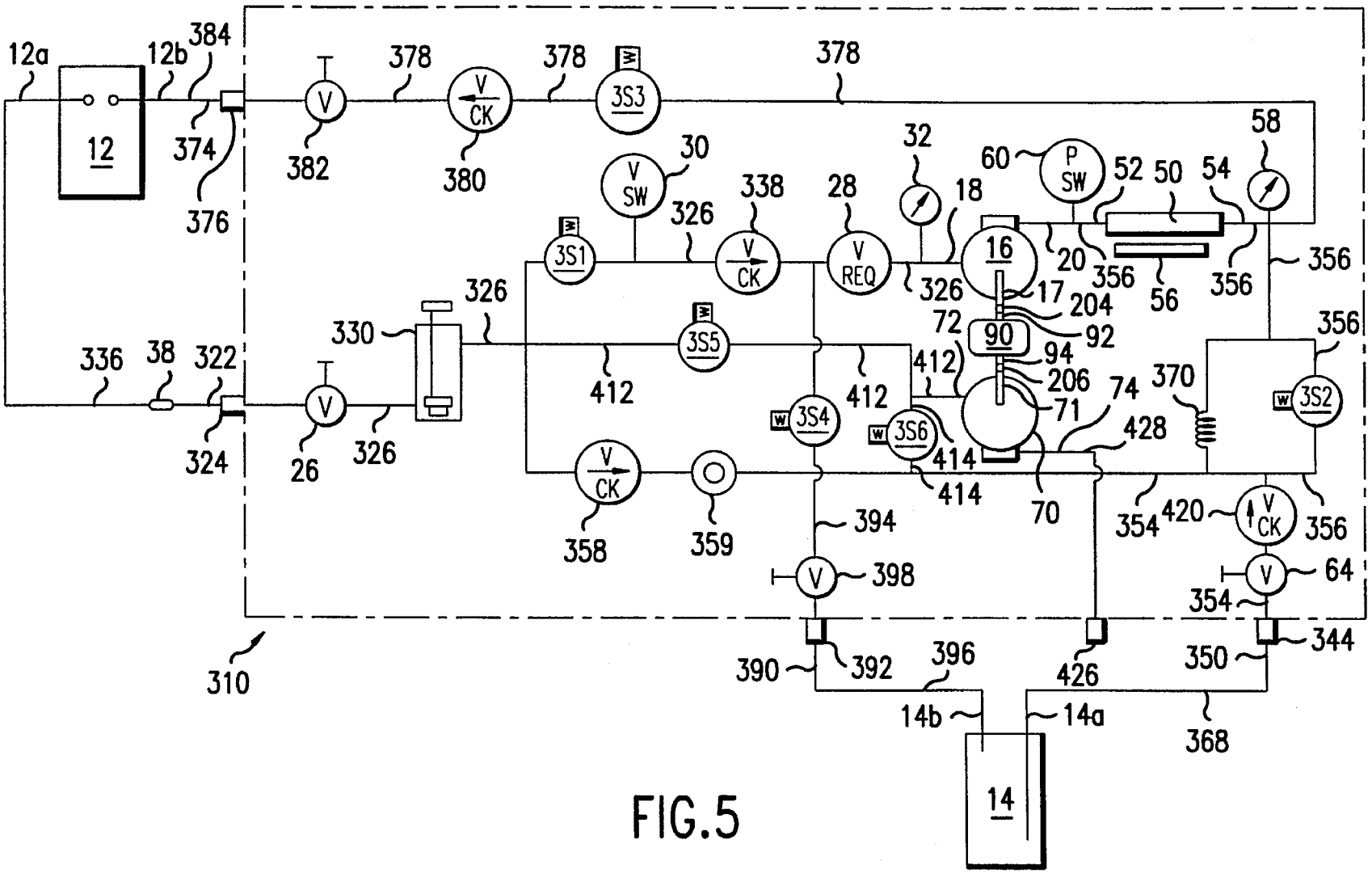
FIG. 5 is a schematic diagram of a third embodiment of a refrigerant recovery, evacuation and recharging apparatus.

Referring now to FIG. 5, a third embodiment of a combined refrigerant recovery, evacuation and recharging apparatus, generally designated 310 (hereinafter "the refrigerant recovery apparatus 310"), in accordance with the present invention is shown. The third embodiment of the refrigerant recovery apparatus 310 utilizes a push-pull refrigerant recovery arrangement to first remove liquid refrigerant from a first container 12 at a higher transfer rate, and then switches to a vapor recovery mode to remove the remaining refrigerant. Identical components from the first and second embodiments have been identified with the same reference numerals, however, to avoid confusion the solenoid valves have been designated with the prefix "3".

For example, the first solenoid valve for the third embodiment has been designated "3S1".

The refrigerant recovery apparatus 310 is used for transferring refrigerant from a first container 12 to a second container 14, as described above. The first container 12 has a liquid port 12*a* and a vapor port 12*b* and the second container 14 also includes a liquid port 14*a* and a vapor port 14*b*. The present invention is not limited to use with the specific types of refrigerant containers and may also be used to recover refrigerant from other closed refrigerant systems, as discussed above.

Still with reference to FIG. 5, the refrigerant recovery apparatus 310 (encompassed in phantom lines) includes the compressor 16 with the suction side 18 and the discharge side 20. The compressor 16 is driven by the motor 90.

A first refrigerant inlet 324 adapted for receiving refrigerant from the first container 12 is provided on the refrigerant recovery apparatus 310. The first refrigerant inlet 324 preferably includes a first hose coupling fitting 322 exposed on the refrigerant recovery apparatus 310. The first refrigerant inlet 324 and first hose coupling fitting 322 are in fluid communication with the suction side 18 of the compressor 16 via a first conduit 326. The first conduit 326, and the other conduits of the refrigerant recovery apparatus 310 described hereinafter, are preferably formed from copper tubing, as noted above.

The first hose coupling fitting 322 is connected to the liquid port 12*a* of the first container 12 through a first flexible refrigerant "inlet" hose 336. Preferably, the first flexible refrigerant hose 336 is a flexible refrigerant hose of the type generally known to those of ordinary skill in the art, similar to the first refrigerant hose 36 described above in connection with the first embodiment 10. The pre-filter 38 is preferably fluidly connected with the first inlet hose 336. The first manual shut-off valve 26 is located along the first conduit 326.

A liquid/vapor switch 330 is coupled between the first refrigerant inlet 324 and the suction side 18 of the compressor 16. More particularly, the liquid/vapor switch 330 is located along the first conduit 326 and is suitably positioned to detect whether refrigerant passing into the apparatus 310 through the first refrigerant inlet 324 is in a liquid state or a vapor state.

A first valve 3S1, actuatable between an open state and a closed state, is located between the first refrigerant inlet 324 and the compressor 16. Preferably, the first valve 3S1 is a solenoid valve and is located in series in the first conduit 326 between the liquid/vapor switch 330 and the compressor 16. Preferably, the first solenoid valve 3S1 is electrically actuated. However, those of ordinary skill in the art will recognize from the present disclosure that other types of remotely actuated valves, such as mechanically actuated or pressure or vacuum actuated valves, can be used if desired.

The vacuum switch 30 is located along the first conduit 326 between the liquid/vapor switch 330 and the compressor 16. The vacuum switch 30 detects the vacuum pressure generated by the compressor 16. When the vacuum pressure reaches a predetermined level, preferably approximately 10 inches of Hg, the vacuum switch 30 switches the refrigerant recovery apparatus 310 to the evacuation mode, as will be described in more detail below.

A first check valve 338, the vacuum switch 30, the pressure regulator 28, and the pressure gauge 32 are preferably located in series along the first conduit 326 between the first solenoid valve 3S1 and the compressor 16. Preferably, the check valve 338 is of the type generally known to those of ordinary skill in the art, and further description is not believed to be necessary or limiting.

The pressure regulator 28 and the low pressure gauge 32 are also located along the first conduit 326 between the check valve 338 and the compressor 16.

Still with reference to FIG. 5, a first refrigerant outlet 350 adapted for connection to the second container 14 is provided. The first refrigerant outlet 50 includes a second hose coupling fitting 344 exposed on the refrigerant recovery apparatus 310. The first refrigerant outlet 350 is in fluid communication with the first refrigerant inlet through a second conduit 354. More particularly, the second conduit 354 is attached to the first conduit 326 at a position between the liquid/vapor switch 330 and the suction side 18 of the compressor 16.

A check valve 358 and a sight glass 359 are located in series along the second conduit 354. The check valve 358 prevents back-flow of refrigerant toward the liquid/vapor switch 330 and the sight glass 359 allows the operator to observe when liquid refrigerant is being transferred, as explained in more detail below.

The first refrigerant outlet 350 is also in fluid communication with the discharge side 20 of the compressor 16 through a third conduit 356, with the third conduit 356 being connected to the second hose coupling fitting 344 via the second conduit 354.

The condenser 50 is located along the third conduit 356. The condenser inlet 52 is in fluid communication with the discharge side 20 of the compressor 16 and the condenser outlet 54 is in fluid communication with the first refrigerant outlet 350 via the third conduit 356 and the second conduit 354. The condenser fan 56 is located adjacent to the condenser 50 to force cooling air through the condenser 50.

The high-pressure cut-off switch 60 is located along the third conduit 356 between the condenser inlet 52 and the discharge side 20 of the compressor 16. The high-pressure cut-off switch 60 is preferably set at a predetermined pressure, which is approximately 425 psi in the third embodiment 310, and cuts off power to the compressor motor 90 when the pressure on the discharge side 20 of the compressor 16 exceeds the predetermined pressure to protect the equipment and the containers from damage.

Preferably, the pressure gauge 58 is located along the third conduit 356 between the condenser outlet 54 and the first refrigerant outlet 350. The pressure gauge 58 is suitable for measuring high pressure.

A second valve 3S2, actuatable between an open state and a closed state, is located between the condenser outlet 54 and the first refrigerant outlet 350. Preferably, the second valve 3S2 is a solenoid valve similar to the first valve 3S1, and is located along the third conduit 356.

A capillary tube 370 is located in parallel with the second valve 3S2 along the third conduit 356 and is connected to the second conduit 354. The capillary tube 370 is in fluid communication between the discharge side 20 of the compressor and the first refrigerant outlet 350. More particularly, the capillary tube 370 is connected between the condenser outlet 54 and the first refrigerant outlet 350. The capillary tube 370 is of the type known to those of ordinary skill in the art from the present disclosure, and in a preferred embodiment is approximately thirtytwo (32) inches long and has a nominal internal diameter of 0.040 inches. The skilled artisan will also understand from the present disclosure that other throttling devices can be used in place of the capillary tube 370, if desired.

The second manual shut-off valve 64 is located along the second conduit 354, adjacent to the first refrigerant outlet 350. A second flexible refrigerant hose 368, similar to the first flexible refrigerant hose 336 is connected between the second hose coupling fitting 344 of the first refrigerant outlet 350 and the liquid port **14*a* of the second container 14**.

A second refrigerant outlet 374 is provided on the refrigerant recovery apparatus 310. The second refrigerant outlet 374 is adapted for connection to the first container 12, and more particularly to the vapor port **12*b* of the first container 12, and is in fluid communication with the condenser outlet 54. The second refrigerant outlet 374 includes a third hose coupling fitting 376 exposed on the refrigerant recovery apparatus 310 which is in fluid communication with the condenser outlet 54 via a fourth conduit 378**.

A third valve 3S3, actuatable between an open state and a closed state, a second check valve 380 and a third manual shut-off valve 382 are located in series along the fourth conduit 378 between the condenser outlet 54 and the second refrigerant outlet 374. Preferably, the third valve 3S3 is a solenoid valve, similar to the first and second solenoid valves 3S1 and 3S2. The second check valve 380 prevents back-flow of refrigerant from the first container 12 through the fourth conduit 378 toward the condenser outlet 54. The second check valve 380 and the third manual shut-off valve 382 are similar to those described above, and accordingly further description is not believed to be necessary.

A third flexible refrigerant hose 384 is preferably used to connect the second refrigerant outlet 374 to the vapor port **12*b* of the first container 12. The third flexible refrigerant hose 384 is similar to the first and second flexible refrigerant hoses 336 and 368**, as described above.

A second refrigerant inlet 390, adapted for receiving vaporized refrigerant from the second container 14, is provided on the refrigerant recovery apparatus 310. The second refrigerant inlet 390 is in fluid communication with the suction side 18 of the compressor 16. The second refrigerant inlet 390 includes a fourth hose coupling fitting 392 exposed on the refrigerant recovery apparatus 310 and is in fluid communication with the suction side 18 of the compressor 16 via a fifth conduit 394.

preferably, a fourth flexible refrigerant hose 396 is connected between the vapor port **14*b* of the second container 14 and the fourth hose coupling fitting 392. The fourth flexible refrigerant hose 396 is similar to the first, second and third flexible refrigerant hoses 336, 368 and 384**, described above.

A fourth valve 3S4, actuatable between an open state and a closed state, is located between the second refrigerant inlet 390 and the compressor 16. More particularly, the fourth valve 3S4 is a solenoid valve similar to the first, second and third solenoid valves 3S1, 3S2, and 3S3, described above, and is located along the fifth conduit 394 between the suction side 18 of the compressor 16 and the second refrigerant inlet 390. A fourth manual shut-off valve 398 is also located along the fifth conduit 394 adjacent to the second refrigerant inlet 390. The fifth conduit 394 is connected to the first conduit 326 in a position between the first check valve 338 and the pressure regulator 28.

Still with reference to FIG. 5, the third embodiment of the refrigerant recovery apparatus 310 includes the vacuum pump 70. The suction side 72 of the vacuum pump 70 is in fluid communication with the first refrigerant inlet 324. Preferably, the suction side 72 of the vacuum pump 70 is in fluid communication with the first conduit 326 between the liquid/vapor switch 330 and the first solenoid valve 3S1 via a sixth conduit 412. The vacuum pump 70 is also in fluid communication with the suction side of the compressor 16 via the fifth conduit 394, which intersects the sixth conduit 412 between the fourth solenoid valve 3S4 and the intersection with the first conduit 326.

The motor 90 is coupled with and drivingly engageable to the vacuum pump 70 and the compressor 16. The motor 90 has two output shafts 92 and 94, with the first output shaft 92 driving the compressor 16 and the second output shaft 94 driving the vacuum pump 70. It is understood by those of ordinary skill in the art that the motor 90 may be coupled with clutches, direct drive couplings, pulleys and belts, reduction gears or other suitable drive systems to the compressor 16 and the vacuum pump 70, and the type of drive system between the motor 90 and the compressor 16 and vacuum pump 70 is not critical.

A fifth valve 3S5, actuatable between an open state and a closed state is provided between the suction side 72 of the vacuum pump 70 and the first refrigerant inlet 324. Preferably, the fifth valve 3S5 is a solenoid valve similar to the first through fourth solenoid valves 3S1–3S4 described above, and is located along the sixth conduit 412.

A sixth valve 3S6, actuatable between an open state and a closed state, is located between the suction side 72 of the vacuum pump 70 and the second conduit 354. Preferably, the sixth valve 3S6 is a solenoid valve similar to the first through fifth solenoid valves 3S1–3S5 described above, and is located along a seventh conduit 414 which is in fluid communication between the sixth conduit 412 and the second conduit 354.

Another check valve 420 is located along the second conduit 354, adjacent to the second manual shut-off valve 64 to prevent back flow of refrigerant from the second container 14.

The discharge side 74 of the vacuum pump 70 is in fluid communication with a third refrigerant outlet 426, which is exposed at least to the atmosphere on the refrigerant recovery apparatus 310, via an eighth conduit 428.

Figure 6:
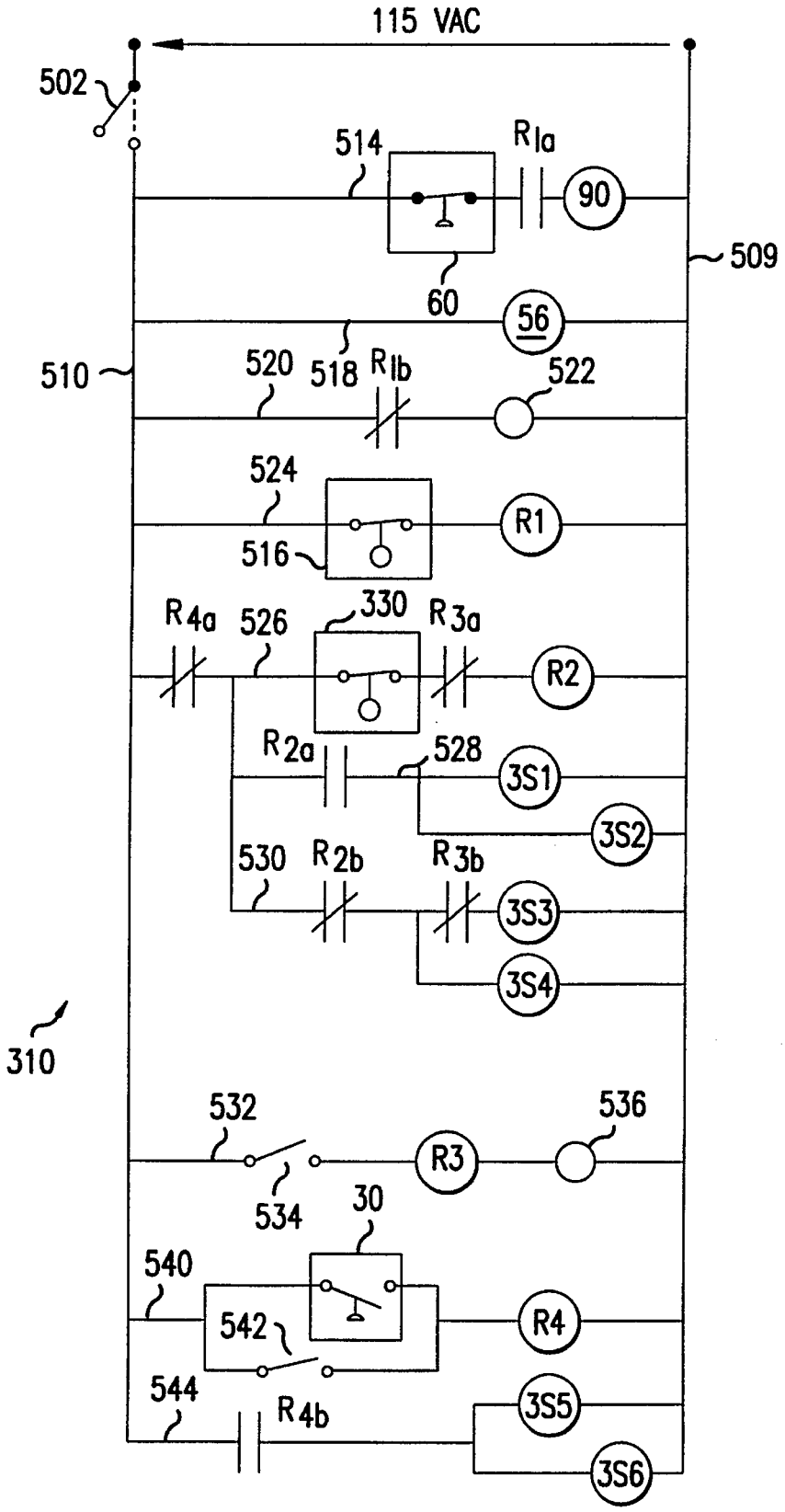
FIG. 6 is a schematic wiring diagram of the third embodiment of the refrigerant recovery and recycling apparatus.

Referring now to FIG. 6, a schematic wiring diagram for the refrigerant recovery apparatus 310 is shown. An ON/OFF switch 502 is connected across a power source which is preferably a 115 volt AC source, to control power to the refrigerant recovery apparatus 310. When the switch 502 is in the "ON" position (as shown in phantom), power is provided by conductors 509 and 510 to the parallel circuits as described below.

The first circuit element 514, which is 10 electrically connected in parallel between conductors 509 and 510, provides power to the motor 90 for driving the compressor 16 and the vacuum pump 70. The first circuit element 514 comprises the high-pressure cut-off switch 60, a first switch R1*a* of a first relay R1, described in detail below, electrically connected in series with the motor 90.

The first relay switch R1*a* of the first relay R1 is closed when a tank float switch 516 in the second container 14 indicates that the second container is not full, as described in more detail below. When the second container 14 is full, the first relay switch R1*a* of the first relay R1 is opened and interrupts the electrical connection to the motor 90. The electrical connection through the first circuit 514 is also interrupted when the high-pressure cut-off switch 60 detects a compressor discharge pressure above a predetermined level (preferably approximately 425 psi).

A second circuit element 518 is electrically connected in parallel between the conductors 509 and 510 to provide power to the condenser cooling fan 56 when the ON/OFF switch 110 is on.

A third circuit element 520 is electrically connected in parallel between the conductors 509 and 510 to provide power to an indicator light 522 which indicates when the second container 14 has been filled. The third circuit element 520 comprises a second relay switch R1*b* of the first relay R1, described in more detail below, connected in series with the indicator light 522. The second relay switch R1*b* of the first relay R1 closes when the second container 14 is full providing power to the indicator light 522.

A fourth circuit element 524 is electrically connected in parallel between the conductors 509 and 510. The fourth circuit element 524 comprises the tank float switch 516 for the second container 14 electrically connected in series with the first relay R1. When the second container 14 is full, the tank float switch 516 opens, interrupting the electrical connection to the relay R1. The first relay R1 then causes the first relay switch R1*a* to open, as described above, to interrupt power to the compressor motor 90, and the second relay switch R1*b* to close, providing power to the indicator light 522.

A fifth circuit element 526 is electrically connected in parallel between conductor 509 and a first relay switch R4*a* of a fourth relay R4, which is attached to the conductor 510. The fifth circuit element comprises the liquid/vapor switch 330 electrically connected in series with a first relay switch R3*a* of a third relay R3, described in detail below, and a second relay R2. The first relay switch R3*a* of the third relay is normally closed unless power is provided to the third relay R3 in connection with the subcooling mode described in detail below. When the liquid/vapor switch 330 is open, indicating that liquid refrigerant is being recovered by the refrigerant recovery apparatus 310, no power is provided to the second relay R2. When the liquid/vapor switch 330 is closed, indicating that vaporized refrigerant is being recovered by the refrigerant recovery apparatus 310, power is provided to the second relay R2, which activates the first and second switches R2*a* and R2*b* of the second relay R2, as described below.

A sixth circuit element 528 is electrically connected in parallel with the fifth circuit element 526 between the conductor 509 and the first relay switch R4*a* of the fourth relay R4. The sixth circuit element 528 comprises the first relay switch R2*a* of the second relay R2 electrically connected in series with the first and second solenoid valves 3S1 and 3S2, which are electrically connected in parallel. When the liquid/vapor switch 330 is closed, indicating that vaporized refrigerant is being recovered, the second relay R2 is provided with power, and actuates the first relay switch R2*a* of the second relay R2 to close. When the first relay switch R2*a* of the second relay R2 closes, power is provided to open the first and second solenoid valves 3S1 and 3S2. When the liquid/vapor switch 330 is open, indicating that liquid refrigerant is being recovered, the first relay switch R2*a* of the second relay R2 is open, and the first and second solenoid valves 3S1 and 3S2 remain closed.

A seventh circuit element 530 is electrically connected in parallel with the fifth and sixth circuit elements 526, 528 between the conductor 509 and the first relay switch R4*a* of the fourth relay R4, which is attached to the conductor 510. The seventh circuit element 530 comprises a second relay switch R2*b* of the second relay R2 electrically connected in series with a second relay switch R3*b* and the third solenoid valve 3S3. The fourth solenoid valve 3S4 is electrically connected in parallel with the second relay switch R3*b* of the second relay R3 and the third solenoid valve 3S3. When the liquid/vapor switch 330 is open, indicating that liquid refrigerant is being recovered by the refrigerant recovery apparatus, no power is provided to the second relay R2 in the fifth circuit element 526, and the second relay switch R2*b* of the second relay R2 remains closed. The second relay switch R3*b* of the third relay R3 is also closed, except during operation in the subcooling mode as described in detail below. Accordingly, when liquid refrigerant is being recovered, power is provided to the third and fourth solenoid valves 3S3 and 3S4 to open the third and fourth solenoid valves 3S3 and 3S4. When the liquid/vapor switch 330 is closed, indicating that vaporized refrigerant is being recovered, power is provided to the second relay R2, causing the second relay switch R2*b* of the second relay R2 to open, interrupting power to the third and fourth solenoid valves 3S3 and 3S4, causing the third and fourth solenoid valves 3S3 and 3S4 to close.

The fifth, sixth and seventh circuit elements 526, 528 and 530 are isolated by the first relay switch R4*a* for the fourth relay R4, described in more detail below. The first relay switch R4*a* of the fourth relay R4 is closed during recycling operations, and is only activated to interrupt power to the fifth, sixth and seventh circuit elements 526, 528 and 530 when the third embodiment of the refrigerant recovery apparatus 310 is in the evacuation mode, described in more detail below.

An eighth circuit element 532 is electrically connected between the conductors 509 and 510. The eighth circuit element 532 comprises a subcool mode ON/OFF switch 534 electrically connected in series with the third relay R3 and a subcool mode timer 536. When the subcool mode is desired, the operator closes the subcool mode ON/OFF switch 534 providing electrical power to the third relay R3.

This causes the first and second relay switches R3*a* and R3*b* of the third relay R3 to open, interrupting power to the second relay R2, and consequently the first and second solenoid valves 3S1 and 3S2 of the sixth circuit element 528, and the third solenoid valve 3S3 of the seventh circuit element 530, causing the first, second and third solenoid valves, 3S1, 3S2 and 3S3 to close. The fourth solenoid valve 3S4 receives electrical power and remains open. After a predetermined time, the timer 536 opens the subcool switch 534.

A ninth circuit element 540 is electrically connected between the conductors 509 and 510. The ninth circuit element 540 comprises the vacuum switch 30 electrically connected in series with the fourth relay R4. A separate evacuation mode switch 542 is electrically connected in parallel with the vacuum switch 30 and in series with the fourth relay R4.

A tenth circuit element 544 is electrically connected in parallel between the conductors 509 and 510. The tenth circuit element 544 comprises the second relay switch R4*b* of the fourth relay R4 connected in series with the fifth and sixth solenoid valves 3S5 and 3S6, which are connected in parallel to each other. The second relay switch R4*b* of the fourth relay R4 is open except during evacuation, such that the fifth and sixth solenoid valves 3S5 and 3S6 remain closed to isolate the vacuum pump 70.

When the vacuum switch 30 detects a predetermined vacuum pressure at the suction side of the compressor 16, the vacuum switch 30 closes, providing power to the fourth relay R4 which causes the first relay switch R4*a* of the fourth relay R4 to open and the second relay switch R4*b* of the fourth relay R4 to close. The evacuation mode switch 542 can be used to operate the refrigerant recovery apparatus 310 in the evacuation mode by providing power to the fourth relay R4 prior to having a predetermined vacuum pressure at the suction side 18 of the compressor 16.

When power is provided to the fourth relay R4, either by the vacuum switch 30 or the evacuation switch 542, the second relay switch R4*b* of the fourth relay R4 closes, providing power to the fifth and sixth solenoid valves 3S5 and 3S6. The first relay switch R4*a* of the fourth relay R4 opens in response to the fourth relay R4 receiving power, cutting off power to the first through fourth solenoid valves 3S1–3S4, causing the first through fourth solenoid valves 3S1–3S4 to close.

The method for recovering refrigerant from the first container 12, storing the refrigerant in the second container 14, and evacuating the first container 12 according to the present invention will now be described for the first, second and third embodiments of the refrigerant recovery apparatus 10, 210 and 310.

Referring to FIGS. 1 and 2, in the first embodiment 10 to prepare for refrigerant recovery from the first container 12, the first container 12 is connected to the first hose coupling fitting 22 by the inlet refrigerant hose 36 which is connected to the vapor port of the first container 12. Preferably, the pre-filter 38 is connected in the inlet hose 36. A valve (not shown) on the first container 12 and the first shut-off valve 26 on the refrigerant recovery apparatus 10 are opened. The second container 14 is connected to the second hose coupling fitting 44 with a second flexible refrigerant hose 68. Preferably, the hose 68 is connected to the liquid port of the second container 14. The second shut-off valve 64 on the apparatus 10 and the valve (not shown) on the second container 14 are then opened.

Power is provided to the refrigerant recovery apparatus 10 and the ON/OFF switch 102 is placed in the "ON" position to remove refrigerant from the first container 12. Power is provided through the first circuit element 111 to the motor 90 and through the second relay switch Rb in the third circuit element 113 to the first clutch 96, such that the motor 90 drives the compressor 16. The recovery indicator light 104 is also lit. The compressor 16 draws refrigerant from the first container 12 through the pressure regulator 28, which regulates the pressure of the incoming refrigerant, to the suction side 18 of the compressor 16. The compressor 16 compresses the refrigerant from the first container 12 to form a relatively high temperature, high pressure vaporized refrigerant. The relatively high temperature, high pressure vaporized refrigerant is passed from the discharge side 20 of the compressor 16 through the second conduit 46 to the condenser 50. The condenser 50 condenses the high temperature, high pressure vaporized refrigerant to form a high temperature, high pressure liquid refrigerant. The condensed refrigerant is passed through the third conduit 48, the check valve 62, and the second flexible refrigerant hose 68 into the second container 14. The compressor 16 continues to operate, drawing refrigerant from the first container 12 and passing it through the apparatus 10 and into the second container 14. The amount of refrigerant in the second container 14 must be monitored, and the second container 14 must be replaced with another empty container if it becomes full. Generally, the amount of refrigerant in the second container can be monitored by weight.

As the volume of refrigerant in the first container 12 is depleted, the compressor 16 generates a vacuum pressure within the first container 12. The vacuum switch 30 detects a predetermined vacuum pressure within the first container 12, preferably about 10 inches of causing the vacuum switch 30 to close. At this point over 97% of the refrigerant has been recovered from the first container 12 and transferred to the second container 14, and only residual amounts of refrigerant remain in the first container 12.

Referring to FIG. 2, when the vacuum switch 30 closes, power is provided to the relay R causing the first relay switch Ra to close and the second relay switch Rb to open. This causes the first electric clutch 96 to disengage the compressor 16 from the motor 90 and the second electric clutch 98 to engage the motor 90 with the vacuum pump 70. Referring again to FIG. 1, the first and second solenoid valves S1 and S2 open, connecting the suction side 18 and discharge side 20 of the compressor 16 to the suction side 72 of the vacuum pump 70 via the fourth and fifth conduits 78 and 82. The vacuum pump 70 is then driven by the motor 90 through the engagement of the second clutch 98 upon detection of the predetermined vacuum pressure in the first container 12. The vacuum pump 70 evacuates the first container 12 and the apparatus 10, discharging the small residual amounts of refrigerant in the system to atmosphere through the sixth conduit 88 and the third hose coupling fitting 86. Optionally, another container (not shown) can be attached to the third hose coupling fitting 86 to collect the residual amount of refrigerant being discharged.

If there is no refrigerant in the first container 12, the first container can be evacuated of air, moisture, or any residual matter prior to recharging with refrigerant by connecting the first container 12 to the first hose coupling fitting 22 as shown in FIG. 1. The first shut-off valve 26 is opened and the valve on the first container 12 is opened. Power is provided to the motor 90 by turning the ON/OFF switch 102 "ON". The evacuation bypass switch 108 is also turned on, such that the second clutch drivingly engages the motor 90 to the vacuum pump 70 to draw a vacuum on the apparatus 10 and the first container 12. When the pressure gauge 32 indicates approximately 20 to 29.92 inches Hg, the apparatus 10 is turned off.

After service on the first container 12 is completed, the first container 12 can be recharged with the refrigerant stored in the second container 14 by reversing the connections between the refrigerant recovery apparatus 10 and the first and second containers 12 and 14 such that the first container 12 is connected to the second hose coupling fitting 44 and the second container 14 is connected to the first hose coupling fitting 22.

The method for recovering refrigerant from the first container 12, storing the refrigerant in the second container 14, and evacuating the first container 12 for the second embodiment of the invention 210 is similar to the first embodiment 10.

Referring to FIGS. 3 and 4, the first and second containers are connected to the refrigerant recovery apparatus 210 in the same manner as described above for the first embodiment of the invention 10.

Referring to FIG. 4, power is provided to the refrigerant recovery apparatus 210 and the ON/OFF switch 102 is placed in the "ON" position to remove refrigerant from the first container 12. Power is provided through the first circuit element 111 to the motor 90, which drives the compressor 16 and the vacuum pump 70, and through the second relay switch Rb in the sixth circuit element 216 to open the third solenoid valve S3. The recovery indicator light 104 is also lit. The compressor 16 draws refrigerant from the first container 12 through the third solenoid valve S3 and the pressure regulator 28, which regulates the pressure of the incoming refrigerant, to the suction side 18 of the compressor 16. The compressor 16 compresses the refrigerant from the first container 12 to form a relatively high temperature, high pressure vaporized refrigerant. The relatively high temperature, high pressure vaporized refrigerant is passed from the discharge side 20 of the compressor 16 through the second conduit 46 to the condenser 50. The condenser 50 condenses the high temperature, high pressure vaporized refrigerant to form a high temperature, high pressure liquid refrigerant. The condensed refrigerant is passed through the third conduit 48, the check valve 62, and the second flexible refrigerant hose 68 into the second container 14. The compressor 16 continues to operate, drawing refrigerant from the first container 12 and passing it through the apparatus 10 and into the second container 14. The amount of refrigerant in the second container 14 must be monitored, and the second container 14 must be replaced with another empty container if it becomes full. Generally, the amount of refrigerant in the second container can be monitored by weight.

The vacuum pump is isolated during refrigerant recovery by the first solenoid valve S1, located adjacent to the inlet at the suction side 72 of the vacuum pump 70, and only creates a minimal additional load on the motor 90.

As the volume of refrigerant in the first container 12 is depleted, the compressor 16 generates a vacuum pressure within the first container 12. The vacuum switch 30 detects a predetermined vacuum pressure within the first container 12, preferably between 10 and 15 inches of Hg, causing the vacuum switch 30 to close. At this point over 97% of the refrigerant has been recovered from the first container 12 and transferred to the second container 14, and only residual amounts of refrigerant remain in the first container 12.

When the vacuum switch 30 closes, power is provided to the relay R causing the first relay switch Ra to close and the second relay switch Rb to open. This causes the third solenoid valve S3 to actuate to a closed state, closing off the inlet to the suction side 18 of the compressor 16, and the first and second solenoid valves S1 and S2 to actuate to an open state, connecting the first conduit 24 and discharge side 20 of the compressor 16 to the suction side 72 of the vacuum pump 70 via the fourth and fifth conduits 78 and 82. The vacuum pump 70 is driven by the motor 90 to evacuate the first container 12 and the apparatus 210, discharging the small residual amounts of refrigerant in the system to atmosphere through the sixth conduit 88 and the third hose coupling fitting 86. Optionally, another container (not shown) can be attached to the third hose coupling fitting 86 to collect the residual amount of refrigerant being discharged. The suction side 18 of the compressor is isolated by the third solenoid valve S3, and driving the compressor 16 during evacuation only places a minimal additional load on the motor 90.

If there is no refrigerant in the first container 12, the first container 12 can be evacuated, of air, moisture, or any residual matter prior to recharging with refrigerant in the same manner as described above in connection with the first embodiment 10. The only difference in the second embodiment 210 is that the compressor 16 is driven by the motor 90 while the first container 12 is evacuated, with the inlet to the suction side 18 of the compressor 16 being isolated by the third solenoid valve S3. When the pressure gauge 32 indicates approximately 20 to 29.92 inches Hg, the apparatus 10 is turned off.

The method of recovering refrigerant from the first container 12 and storing it in the second container 14 with the third embodiment of the refrigerant recovery apparatus 310 will be described with reference to FIGS. 5 and 6.

To prepare for refrigerant recovery from the first container 12, the liquid port **12*a* on the first container 12 is connected to the first refrigerant inlet 324 on the refrigerant recovery apparatus 10 with the first flexible refrigerant hose 336. Preferably, the pre-filter 38 is fluidly connected with the hose 336, and the hose 336 is removably connected to the first hose coupling fitting 322 on the refrigerant recovery apparatus 310. The second flexible refrigerant hose 368 is removably connected between the second hose coupling fitting 344 of the first refrigerant outlet 350 on the refrigerant recovery apparatus 10 and the liquid port 14*a* on the second container 14. The third flexible refrigerant hose 384 is removably connected between the third hose coupling fitting 376 of the second refrigerant outlet 374 on the recovery apparatus 310 and the vapor port 12*b* on the first container 12. The fourth flexible refrigerant hose 396 is removably connected between the fourth hose coupling fitting 392 of the second refrigerant inlet 390 on the recovery apparatus 310, and the vapor port 14*b* on the second container 14. The first, second, third and fourth manual shut-off valves 26, 64, 382 and 398 on the recovery apparatus 310 are opened and the valves (not shown) on the first and second containers 12 and 14** are also opened.

Referring to FIG. 6, power is then provided to the refrigerant recovery apparatus 310 and the ON/OFF switch 502 is placed in the ON position to remove refrigerant from the first container 12. Power is provided through the first circuit element 514 for driving the motor 90 to drive the compressor 16 and the vacuum pump 70. The compressor 16 generates a relatively lower pressure at the suction side 18 to withdraw refrigerant through the liquid port **12*a* of the first container 12. The refrigerant is drawn into the recovery apparatus 310 through the first refrigerant inlet 324 and through the first conduit 326 to the liquid/vapor switch 330. The liquid/vapor switch 330 determines if the refrigerant from the first container 12** is in a liquid state or a vapor state.

If the refrigerant drawn from the first container 12 is in a liquid state, the liquid/vapor switch 330 changes state and interrupts power through the fifth circuit element 526, causing the second relay R2 to open its first relay switch R2*a* and close its second relay switch R2*b*. In response to the second relay switch R2*b* of the second relay R2 closing, an electrical connection through the seventh circuit element 530 is established and the third and fourth solenoid valves 3S3 and 3S4 are opened, and the first relay switch R2*a* of the second relay R2 interrupts the electrical connection through the sixth circuit element 528, causing the first and second solenoid valves 3S1 and 3S2 to close. The liquid refrigerant automatically passes from the first conduit 326 to the second conduit 354, through the second check valve 358 and the sight glass 359, bypassing the condenser 50 and the compressor 16. With the second solenoid valve 3S2 closed and the capillary tube 370 offering high resistance to fluid flow, the liquid refrigerant passes through the first refrigerant outlet 350 and the liquid port 14*b* into the second container 14.

In order to force additional liquid refrigerant from the first container 12 at a high recovery rate, the compressor 16 draws vaporized refrigerant from the vapor port 14*b* of the second container 14 into the recovery apparatus 310 through the second refrigerant inlet 390, the fifth conduit 394 and the fourth solenoid valve 3S4 toward the compressor suction side or inlet 18. The first check valve 338 prevents back flow of the vaporized refrigerant in the first conduit 326 toward the first container 12. The vaporized refrigerant from the second container 14 is compressed by the compressor 16 to a high temperature, high pressure vaporized state, and passed through the discharge side 20 of the compressor 16 to the condenser 50 via the third conduit 356. The high temperature, high pressure refrigerant is condensed to a high temperature, high pressure liquid refrigerant by the condenser 50, and passes through the fourth conduit 378, the third solenoid valve 3S3, the second refrigerant outlet 374 and into the vapor port 12*b* of the first container 12. The high temperature, high pressure refrigerant forces additional liquid refrigerant which is in a lower temperature, lower pressure state in the first container 12 into the recovery apparatus 310 through the first conduit 326 and the second conduit 354 into the second container 14. Due to the refrigerant being pumped into the first container 12 being in a high temperature, high pressure state, liquid refrigerant is pumped into the first container 12 at a rate of approximately 1 lb. per minute, and liquid refrigerant is forced out of the first container 12 at a rate of about 8lbs. per minute, providing a net rate of about 7 lbs. per minute.

In the event that the liquid/vapor switch 330 detects refrigerant in the vapor state, for example, when the recovery apparatus 310 is unable to force additional liquid refrigerant from the first container 12, the liquid/vapor sensor 330 closes and creates and maintains the electrical connection through the fifth circuit element 526, providing electrical power to the second relay R2. The first relay switch R2*a* of the second relay R2 closes, providing power to the first and second solenoid valves 3S1 and 3S2, which open. The second relay switch R2*b* of the second relay R2 opens, interrupting power to the third and fourth solenoid valves 3S3 and 3S4, which close. In the event of waves or surges of liquid refrigerant entering the apparatus 310, a timer (not shown) prevents repetitive on/off switching of the second relay R2 by providing a 3-second delay before providing power to the second relay R2. With the first solenoid valve 3S1 open, the low temperature, low pressure vaporized refrigerant from the first container 12 is drawn through the first conduit 326, the check valve 338 and the pressure regulator 28 to the compressor 16. The low temperature, low pressure vaporized refrigerant is compressed to a high pressure, high temperature vaporized refrigerant. The high temperature, high pressure vaporized refrigerant is passed from the discharge side 20 of the compressor 16 to the condenser 50 where it is condensed to a high temperature, high pressure liquid refrigerant. The high temperature, high pressure, liquid refrigerant passes through the third conduit 356, the second solenoid valve 3S2, into the second conduit 54 and through the first refrigerant outlet 350 to the second container 14. Due to the high flow restriction of the capillary tube 70, little or no refrigerant passes through the capillary tube 70. The second check valve 358 prevents the flow of refrigerant through the second conduit 354 and back into the compressor loop.

When the second container 14 reaches 80% capacity, the tank float switch 516 opens, interrupting the electrical connection through the fourth circuit element 524 and the first relay R1. In response, the first relay switch R1*a* of the first relay R1 interrupts power through the first circuit element 514. The second relay switch R1*b* of the first relay R1 closes, providing an electrical connection through the third circuit element 520, which lights the indicator light 522 to indicate that the second container 14 is full. The valves on the second container 14 and the second and fourth shut-off valves 64 and 398 are closed, and the second container 14 is replaced with an empty container in order to continue the removal of refrigerant from the first container 12.

This process continues until almost all the refrigerant within the first container 12 has been removed. When both the liquid and vaporized refrigerant have been recovered from the first container 12, and the vacuum switch 30 detects a vacuum pressure of 10 inches Hg, the vacuum switch 30 closes providing power to the fourth relay R4 of the ninth circuit element 540. The first relay switch R4*a* of the fourth relay R4 opens, interrupting power to the fifth, sixth and seventh circuit elements 526, 528 and 530, causing the first through fourth solenoid valves 3S1–3S4 to close. The second relay switch R4*b* of the fourth relay R4 closes, providing power to the fifth and sixth solenoid valves, 3S5 and 3S6, which open. The suction side 72 of the vacuum pump 70 is placed in fluid communication with the first container 12 and the suction side 18 of the compressor 16 via the sixth conduit 412, and in fluid communication with the discharge side 20 of the compressor 16 and the condenser 50 via the seventh conduit 414. The vacuum pump 70 evacuates the first container 12 and the apparatus 310 to approximately 20 to 29.92 inches Hg, and expels the residual refrigerant and contaminants in the first container 12 and the apparatus 310 to the atmosphere. When the desired vacuum level is reached, the ON/OFF switch is turned OFF.

If the pressure on the discharge side 20 of the compressor is too high, refrigerant recovery is slowed. Pressure in the second container 14 can be reduced by turning the "subcool mode" on. The subcool mode cools the refrigerant in the second container 14 to reduce the pressure on the discharge side 20 of the compressor 16. The subcool mode is turned on by the subcool mode switch 534 being placed in the ON position. This provides power to the third relay R3, which causes the first relay switch R3*a* of the third relay R3 and the second relay switch R3*b* of the third relay R3 to open. When the first relay switch R3*a* of the third relay R3 opens, power is interrupted to the second relay R2 in the fifth circuit element 526 causing the first and second solenoid valves 3S1 and 3S2 to close. The second relay switch R2*b* of the second relay R2 closes, providing power to the seventh circuit element 530. The second relay switch R3*b* of the third relay R3 interrupts power to the third solenoid valve 3S3, causing the third solenoid valve 3S3 to close. Power is provided to the fourth solenoid valve 3S4, causing the fourth solenoid valve 3S4 to open.

In the subcool mode, vaporized refrigerant is drawn from vapor port 14*b* of the second container 14 through the fifth conduit 394 and the fourth solenoid valve 3S4 to the suction side 18 of the compressor 16 until relatively low temperature, low pressure vaporized refrigerant is being drawn from the second container 14, which is compressed to a high temperature, high pressure vaporized refrigerant and discharged through the discharge side 20 of the compressor 16. The high pressure, high temperature vaporized refrigerant is condensed in the condenser 50 and passes through the third conduit 356 to the capillary tube 370. With the second solenoid valve 3S2 being closed, the high temperature, high pressure vaporized refrigerant is forced through the capillary tube 370 where it is throttled to a low temperature, low pressure mixed liquid/vapor phase refrigerant. The low pressure, low temperature refrigerant passes through the first refrigerant outlet 350 into the second container 14. This has the effect of cooling the refrigerant in the second container 14 and lowering the pressure of the refrigerant in the second container 14. After a predetermined time (e.g. five (5) minutes), timer 536 returns switch 534 to its open state and the recovery process resumes where it had been interrupted.

The evacuation mode can also be actuated separately by the evacuation mode switch 542. This is often required for evacuation of a unit which previously had its refrigerant recovered prior to being opened to the atmosphere for repair and then closed, prior to recharging to remove any moisture or contaminants from the system. This can be done with only the first flexible refrigerant hose 336 connected to the first container 12 and the first manual shut-off valve 26 open, and the second, third and fourth manual shut-off valves 64, 382 and 398 closed.

The evacuation mode switch 542 is turned on providing power to the fourth relay R4, causing the fifth and sixth solenoid valves 3S5 and 3S6 to open, and the first through fourth solenoid valves 3S1–3S4 to close, as described above. After the first container 14 and the apparatus 210 have been evacuated to approximately 20 to 29.92 inches Hg, the ON/OFF switch 502 is turned OFF. Although there is a minor efficiency penalty due to operating the compressor 16 and the vacuum pump 70 from the same motor 90, the loss is minimal.

Referring again to FIGS. 1–6, after service on the first container 12 is completed, the first container 12 can be recharged with the refrigerant stored in the second container 14 with either the first, second or third embodiments of the refrigerant recovery apparatus 10, 210, 310. This is accomplished by reversing the connections between the refrigerant recovery apparatus and the first and second containers 12 and 14 such that the first container 12 is connected to the second hose coupling fitting 44, 344 and the second container 14 is connected to the first hose coupling fitting 22, 322.

The present invention also provides a method of clearing trapped refrigerant from the first, second and third embodiments of the refrigerant recovery apparatus 10, 210 and 310 having the compressor 16 with the suction side 18 adapted for connection to the first container 12, and the discharge side 20 adapted for connection to the second container 14, with the compressor 16 being driven by the motor 90. The method comprises the steps of providing the vacuum pump 70, as described above, with the suction side of the vacuum pump 70 being in fluid communication with the suction and discharge sides 18 and 20 of the compressor 16. The first and second shut-off valves 26 and 64 (and the third and fourth shut-off valves 382 and 398 in the third embodiment 310) are closed. The vacuum pump 70 is operated by the same motor 90 which is used to drive the compressor 16. The vacuum pump 70 draws a vacuum on the suction and discharge sides 18 and 20 of the compressor 16. The residual refrigerant in the refrigerant recovery apparatus 10, 210, 310 is discharged through the discharge side 74 of the vacuum pump 70, to the atmosphere, or optionally to another container.

Those of ordinary skill in the art will understand from the present disclosure that the pre-filter 38 should be used to avoid malfunctioning of the pressure regulator 28, the vapor pressure switch 30, the compressor 16, and the solenoid valves through the introduction of particulate contaminants into the refrigerant recovery apparatus 10. Similarly, the refrigerant recovery apparatus 10, 210, 310 is like a refrigeration unit, and must not be opened to the air. Accordingly, all valves on the refrigerant recovery apparatus must be in a closed position when the refrigerant recovery apparatus is not in use.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A combined refrigerant recovery, evacuation and recharging apparatus for transferring refrigerant from a first container to a second container and evacuating the first container, the apparatus comprising:

a compressor having a suction side and a discharge side, the suction side of the compressor being adapted for connection to the first container;

a vacuum pump having a suction side and a discharge side, the suction side of the vacuum pump being adapted for connection to the first container;

a motor drivingly engageable to the compressor and the vacuum pump.

2. The apparatus of claim 1 further comprising a first hose coupling fitting exposed on the apparatus, the first hose coupling fitting being in fluid communication with the suction side of the compressor and in fluid communication with the suction side of the vacuum pump; and a second hose coupling fitting exposed on the apparatus, the second hose coupling fitting being in fluid communication with the discharge side of the compressor.

3. The apparatus of claim 2 further comprising a first valve, actuatable between an open state and a closed state, in fluid communication between the first hose coupling fitting and the vacuum pump.

4. The apparatus of claim 3 wherein the suction side of the vacuum pump is in fluid communication with the suction side of the compressor.

5. The apparatus of claim 4 further comprising a second valve, actuatable between an open state and a closed state, in fluid communication between the second hose coupling fitting and the vacuum pump.

6. The apparatus of claim 2 further comprising a first clutch connected between the motor and the compressor, the first clutch having a first state in which the motor is drivingly engaged with the compressor and a second state in which the motor is disengaged from the compressor.

7. The apparatus of claim 6 further comprising a second clutch connected between the motor and the vacuum pump, the second clutch having a first state in which the motor is drivingly engaged with the vacuum pump and a second state in which the motor is disengaged from the vacuum pump.

8. The apparatus of claim 7 further comprising a vacuum switch in fluid communication with the first hose coupling fitting to respond to vacuum pressure and coupled with the first and second clutches to reverse the states of the first and second clutches when exposed to a predetermined vacuum pressure.

9. The apparatus of claim 1 wherein the motor is continuously drivingly engaged to both the compressor and the vacuum pump.

10. The apparatus of claim 2 wherein the motor is continuously drivingly engaged to both the compressor and the vacuum pump.

11. The apparatus of claim 10 further comprising:

a first valve, actuatable between an open state and a closed state, in fluid communication between the first hose coupling fitting and the vacuum pump;

a second valve, actuatable between an open state and a closed state, in fluid communication between the second hose coupling fitting and the vacuum pump; and a third valve, actuatable between an open state and a closed state, in fluid communication between the suction side of the compressor and the first hose coupling fitting.

12. The apparatus of claim 11 further comprising a vacuum switch in fluid communication with the first hose coupling fitting to respond to vacuum pressure and coupled with the first, second and third valves to reverse the states of the first, second, and third valves such that the first and second valves are in the open state and the third valve is in the closed state when exposed to a predetermined vacuum pressure.

13. The apparatus of claim 2 further comprising a condenser in fluid communication between the suction side of the compressor and the second hose coupling fitting.

14. A combined refrigerant recovery, evacuation and recharging apparatus for transferring refrigerant from a first container to a second container and evacuating the first container, the apparatus comprising:

a compressor having a suction side and a discharge side, the suction side being in fluid communication with the first container and the discharge side being in fluid communication with the second container;

a vacuum pump having a suction side and a discharge side, the suction side of the vacuum pump being in fluid communication with the first container; and a motor drivingly engageable to the compressor and the vacuum pump.

15. The apparatus of claim 14 further comprising a first clutch connected between the motor and the compressor.

16. The apparatus of claim 15 further comprising a second clutch connected between the motor and the vacuum pump.

17. The apparatus of claim 16 further comprising a vacuum switch in fluid communication with the first container to respond to vacuum pressure and coupled with the first and second clutches to reverse the states of the first and second clutches when exposed to a predetermined vacuum pressure.

18. The apparatus of claim 14 wherein the motor is continuously drivingly engaged to the both compressor and the vacuum pump.

19. The apparatus of claim 18 further comprising:

a first valve, actuatable between an open state and a closed state, in fluid communication between the first container and the vacuum pump;

a second valve, actuatable between an open state and a closed state, in fluid communication between the second container and the vacuum pump; and a third valve, actuatable between an open state and a closed state, in fluid communication between the suction side of the compressor and the first container.

20. The apparatus of claim 19 further comprising a vacuum switch in fluid communication with the first container to respond to vacuum pressure and coupled with the first, second and third valves to reverse the states of the first, second, and third valves such that the first and second valves are in the open state and the third valve is in the closed state when exposed to a predetermined vacuum pressure.

21. A method for recovering refrigerant from a first container, storing the refrigerant in a second container, and evacuating the first container, utilizing the apparatus of claim 1 comprising the steps of:

(a) actuating the motor to drive the compressor;

(b) removing refrigerant from the first container and compressing the refrigerant from the first container with the driven compressor to form a relatively high temperature, high pressure vaporized refrigerant;

(c) condensing the relatively high temperature, high pressure refrigerant from step (b);

(d) passing the condensed refrigerant from step (c) into the second container;

(e) detecting a predetermined vacuum pressure within the first container;

(f) driving the vacuum pump with the motor to evacuate the first container with the vacuum pump upon detecting the predetermined vacuum pressure.

22. A method of clearing trapped refrigerant from the apparatus of claim 1, comprising:

(a) operating the vacuum pump with the motor which drives the compressor;

(c) drawing a vacuum with the vacuum pump on the suction and discharge sides of the compressor;

(d) discharging the refrigerant through the discharge side of the vacuum pump.

23. A method of operating a refrigerant recovery and evacuation apparatus for recovering refrigerant from a first container, transferring the recovered refrigerant to a second container and evacuating the first container and the apparatus, the apparatus including a compressor having a suction side and a discharge side, a first hose coupling fitting exposed on the apparatus, the first hose coupling fitting being in fluid communication with the suction side of the compressor, a second hose coupling fitting exposed on the apparatus, the second hose coupling fitting being in fluid communication with the discharge side of the compressor, a vacuum pump having a suction side and a discharge side, the suction side of the vacuum pump being in fluid communication with the first hose coupling fitting, a motor drivingly engageable to the compressor and the vacuum pump, a first clutch connected between the motor and the compressor, the first clutch having a first state in which the motor is drivingly engaged with the compressor and a second state in which the motor is disengaged from the compressor, a second clutch connected between the motor and the vacuum pump, the second clutch having a first state in which the motor is drivingly engaged with the vacuum pump and a second state in which the motor is disengaged from the vacuum pump, and a vacuum switch in fluid communication with the first hose coupling fitting to respond to vacuum pressure and coupled with the first and second clutches to reverse the states of the first and second clutches when exposed to a predetermined vacuum pressure, wherein the recovery unit is operated in first and second modes with automatic switching from the first mode to the second mode, comprising:

(a) actuating the first clutch to the first state and the second clutch to the second state to engage the motor to drive the compressor;

(b) removing refrigerant from the first container and compressing the refrigerant from the first container with the driven compressor to form a relatively high temperature, high pressure vaporized refrigerant;

(c) condensing the high temperature, high pressure refrigerant from step (b);

(d) passing the condensed refrigerant from step (c) into the second container;

(e) detecting a predetermined vacuum pressure within the first container;

(f) automatically switching to the second mode of operation by reversing the states of the first and second clutches upon detecting the predetermined vacuum pressure;

(g) driving the vacuum pump with the motor upon detecting the predetermined pressure; and (h) evacuating the first container and the refrigerant recovery apparatus with the vacuum pump.

* * * * *